United States Patent [19]

Fuller

[11] Patent Number: 4,790,396

[45] Date of Patent: Dec. 13, 1988

[54] ROTARY DRILL BITS FOR USE IN CORING HOLES IN SUBSURFACE FORMATIONS

[75] Inventor: John Fuller, Penzance, England

[73] Assignee: NL Petroleum Products Limited, England

[21] Appl. No.: 879,137

[22] Filed: Jun. 26, 1986

[30] Foreign Application Priority Data

Jul. 2, 1985 [GB] United Kingdom ..... 16776/85

[51] Int. Cl.[4] ..... E21B 10/02

[52] U.S. Cl. ..... 175/249; 175/403

[58] Field of Search ..... 175/58, 233, 239, 243–255, 175/330, 403, 402; 166/99

[56] References Cited

U.S. PATENT DOCUMENTS

| | | | |
|---|---|---|---|
| 1,484,527 | 2/1924 | Pace | 175/249 |
| 1,703,390 | 2/1929 | Duffy | 175/403 |
| 2,657,016 | 10/1953 | Grable | 175/403 |
| 3,095,935 | 7/1963 | Hildebrandt et al. | 175/330 |
| 4,296,822 | 10/1981 | Ormsby | 175/249 |

FOREIGN PATENT DOCUMENTS

| | | | |
|---|---|---|---|
| 574520 | 9/1977 | U.S.S.R. | 175/58 |

*Primary Examiner*—Hoang C. Dang

*Attorney, Agent, or Firm*—Browning, Bushman, Zamecki & Anderson

[57] ABSTRACT

A rotary drill bit for use in coring holes in subsurface formations comprises a bit body having a shank for connection to a core barrel, an outer peripheral gauge portion for engagement with the peripheral wall of the hole being drilled, an inner peripheral gauge portion defining at least a part of a central, generally circular aperture extending axially through the bit body, a plurality of cutting elements mounted at the surface of the bit body, and passages in the bit body for delivering drilling fluid to the surface of the bit body. Hydraulic sealing means are provided on the inner gauge portion of the bit and, in use, engage the outer surface of the core being cut by the bit. The hydraulic seal thus formed prevents or restricts flow of drilling fluid in an axial direction between the inner gauge portion and the core, and thus substantially reduces erosion of the core.

5 Claims, 2 Drawing Sheets

ROTARY DRILL BITS FOR USE IN CORING HOLES IN SUBSURFACE FORMATIONS

BACKGROUND OF THE INVENTION

The invention relates to rotary drill bits for use in coring holes in subsurface formations and of the kind comprising a bit body having a shank for connection to a core barrel, an outer peripheral gauge portion for engagement with the peripheral wall of the hole being drilled, an inner peripheral gauge portion defining at least a part of a central, generally circular aperture extending axially through the bit body, and a plurality of cutting elements mounted at the surface of the bit body.

Although not essential to the present invention, the cutting elements may be in the form of so-called "pre-form" cutting elements, each element being in the shape of a tablet, usually circular, having a hard cutting face formed of polycrystalline diamond or other superhard material.

The core barrel for use with the bit may be of the known kind which includes an inner wall spaced inwardly from the outer wall of the barrel, a bearing being provided between the two walls so that the inner wall may remain stationary around the core being cut while the main outer wall of the barrel rotates with the bit. The inner wall may carry at its lower end a "core catcher" operable to engage the core being cut adjacent its lower end, when required, so that as the core barrel is subsequently lifted the core breaks in the vicinity of the core catcher and is lifted within the core barrel.

During drilling the cutting elements are normally cleaned and cooled, and cuttings are removed, by pumping drilling fluid down the drill string, into the core barrel and over the surface of the bit. In one common form of bit, the inner gauge of the bit body is formed with axially extending channels so that drilling fluid may reach the outer surface of the bit body from the interior thereof by flowing downwardly through such channels. However, in this case the drilling fluid passes over the surface of the core being cut. This causes erosion of the core which may lead to premature core breakage, difficulties in removing the core from the hole and loss of geological information.

In an effort to overcome such erosion problems, some coring bits are provided with so-called "face-discharge" in which passages for drilling fluid are formed within the bit body itself to permit drilling fluid to flow from the interior of the core barrel to a nozzle in the surface of the bit body. In such arrangements the inner surface of the gauge portion is still often relieved by channels or fluting, although face-discharge bits are also known having a plain inner peripheral gauge unrelieved by channels or fluting.

With known face-discharge coring bits, although the major portion of the flow takes place through the passages in the bit body, there is till a significant amount of flow between the inner gauge and the surface of the core. Since the amount of erosion caused is dependent largely on the velocity of flow over the surface of the core rather than the volume flow rate, and since the velocity of flow is dependent on the pressure drop, it is believed that conventional face-discharge bits do not significantly reduce erosion of the core.

In some designs of core barrel for use with a face-discharge bit, the core catcher is extended and shaped to deflect drilling fluid away from the core. This is however largely ineffective because it still permits some flow of fluid past the core with the consequent erosion which occurs for the reasons mentioned above.

In view of these erosion problems, therefore, it is normally considered necessary to use a much lower pressure drop in the drilling fluid when drilling when a core bit, when compared with other types of full-hole bit. For example, in a full-hole bit the pressure drop might be in the range of 500 to 1200 psi, and occasionally as high as 2000 psi, whereas in core drilling the pressure drop is more likely to be in the range of 50 to 200 psi, although occasionally it may be as high as 400 psi. The present invention sets out to provide an improved form of coring bit and method in which core erosion is reduced or eliminated and which thus permits the use of a greater pressure drop across the coring bit with consequently greater velocity of flow of drilling fluid. This may give better cleaning and cooling of the cutting elements and less risk of blocking of flow channels in the surface of the bit body.

SUMMARY OF THE INVENTION

According to the invention there is provided a rotary dril bit for use in coring holes in subsurface formations, comprising a bit body having a shank for connection to a core barrel, an outer peripheral gauge portion for engagement with the peripheral wall of the hole being drilled, an inner peripheral gauge portion defining at least a part of a central, generally circular aperture extending axially through the bit body, a plurality of cutting elements mounted at the surface of the bit body, at least one passage in the bit body for delivering drilling fluid to the surface of the bit body for cooling and/or cleaning said cutting elements, and sealing means on said inner gauge portion of the bit which, in use, engages the outer surface of the core being cut by the bit in a manner to form an hydraulic seal and prevent or restrict flow of drilling fluid in an axial direction between the inner gauge portion and the core.

The provision of sealing means between the inner peripheral gauge portion of the bit and the outer surface of the core may thus prevent or substantially restrict flow of drilling fluid past the gauge portion, thus substantially reducing or eliminating erosion of the core.

The sealing means may include a labyrinth seal comprising a number of axially spaced peripheral annular grooves, separated by peripheral lands, in the surface of the inner gauge portion. In this case, erosion is still reduced in the event that there is some leakage flow of drilling fluid between the seal and the surface of the core. The pressure drop across each land is only a fraction of the pressure drop across the whole length of the gauge and consequently the velocity of flow of drilling fluid across each land, if such flow should occur, is only a fraction of the velocity of flow which would otherwsie occur across the gauge and thus the erosion caused by the flow across each land is considerably reduced.

The central aperture extending axially through the bit body may include an inner part of larger cross section than the part defined by the inner gauge portion, and at least one passage for delivering drilling fluid to the surface of the bit body may extend through the bit body from said larger cross section part of the aperture to the surface of the bit.

The sealing means may include an annular resilient member received in an annular groove in the inner gauge portion of the bit body, the resilient member being engageable with the outer peripheral surface of the core, in use of the bit.

The annular member may be a resilient O-ring of generally circular cross section or may be in the form of an annular brush-like element, the bristles of which project inwardly to engage the outer surface of the core, in use of the bit, and form an hydraulic seal therewith. Alternatively the annular member may be formed of resilient material and generally V-shaped in cross section, one limb of the V being engageable with the outer peripheral surface of the core.

In another embodiment the resilient annular member is formed from resilient material and has a plurality of axially spaced annular recesses in the inwardly facing surface thereof so as to define, between the recesses, a plurality of inwardly projecting resilient annular flanges, the inner peripheries of which, in use, engage the surface of the core. The inwardly projecting annular flanges may be inclined away from the end face of the bit body.

In a further embodiment, the sealing means may include a tubular liner of circular cross section the inner periphery of which, in use, closely encircles the core being cut and the outer periphery of which is sealingly engaged by said resilient annular member, there being provided a rotatable bearing between the liner and the bit body to permit the bit body to rotate relatively to said liner.

The invention includes within its scope a method of coring a hole in subsurface formations using a rotary drill bit of the kind comprising a bit body having a shank connected to a core barrel, an outer peripheral gauge portion engaging the peripheral wall of the hole being drilled, an inner peripheral gauge portion defining at least a part of a central, generally circular aperture extending axially through the bit body, a plurality of cutting elements mounted at the surface of the bit body, and at least one passage in the bit body for delivering drilling fluid to the surface of the bit body for cooling and/or cleaning the cutting elements, the method comprising forming an hydraulic seal between the inner peripheral gauge portion of the bit body and the core being cut in a manner to prevent or restrict the flow of drilling fluid in an axial direction between the inner peripheral gauge portion and the outer surface of the core.

DETAILED DESCRIPTION OF THE PREFERRED EMBODIMENTS

Figure 1:
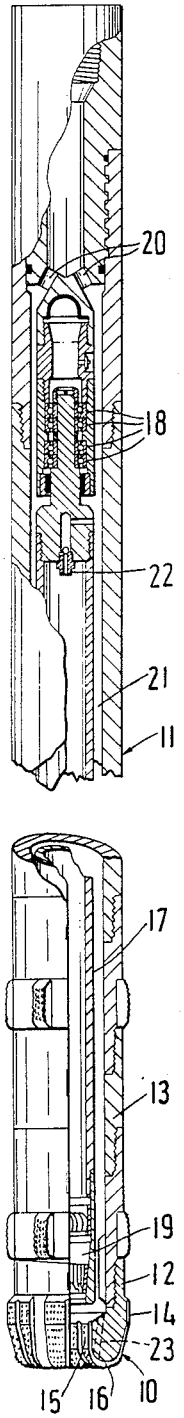
FIG. 1 is a vertical section through a typical coring bit and core barrel.

FIG. 1 shows only one example of a conventional coring assembly, and the invention is by no means applicable only to assemblies of the type illustrated.

Referring to FIG. 1, the coring assembly comprises a core bit 10 mounted on the lower end of a core barrel 11 for connection to a drill string.

The core bit 10, which is a typical prior art coring bit, comprises an internally threaded shank 12 for connection to the lower end of the outer wall 13 of the core barrel, and also includes an outer peripheral gauge portion 14 and an inner peripheral gauge portion 15. Channels 16 extend downwardly across the inner gauge portion, around the lower face of the bit and upwardly across the outer gauge portion to conduct drilling fluid from the interior of the bit body across the face of the bit and upwardly around the core barrel and drill string. Cutting elements, which may be natural or synthetic diamonds (as shown) or preforms or polycrystalline diamond, are mounted at the surface of the bit, between the channels 16.

Within the outer wall 13 of the core barrel is an inner wall 17 mounted at its upper end by bearings 18 so that the inner wall may remain stationary, surrounding the core being cut, as the main outer wall of the core barrel, with the core bit, rotates. A core catcher 19 is provided at the lower end of the inner wall 17. The core catcher may be of any known type.

During drilling, fluid is pumped down the centre of the drill string and passes through passages 20 into the annular space 21 between the inner and outer walls of the core barrel. At the lower end of the core barrel the fluid reaches the face of the bit by passing downwardly along the channels 16 in the inner peripheral gauge of the core bit. The fluid thus passes over the surface of the core being cut, since the core extends upwardly through the centre aperture in the core bit and is disposed within the inner wall 17 of the core barrel. As the core barrel passes downwardly over the core being cut fluid pressure within the inner wall 17 above the top of the core is relieved through a non-return valve 22 at the top of the inner wall.

As previously mentioned, attempts have been made to reduce erosion of the core, caused by flow of drilling fluid across the inner gauge, by providing passages in the bit body to direct drilling fluid to the face of the bit. Such a passage is indicated in dotted lines at 23 in FIG. 1. However, as previously mentioned, it is believed that the provision of such face-discharge passages does not significantly reduce the erosion of the core, particularly if, as is commonly the case, small axially extending channels are still formed in the inner gauge.

According to the invention, no axially extending channels are provided in the inner gauge but, instead, sealing means are provided to provide an hydraulic seal between the gauge and the surface of the core. The sealing means is arranged either to prevent substantially all flow of drilling fluid between the gauge and the core or to reduce the velocity of any flow which does occur so as to reduce the erosion caused thereby. FIGS. 2 to 8 show some types of sealing means which may be employed although the invention is not limited to the particular types of seal illustrated. Also, of course, the invention is not limited to the type of coring assembly shown in FIG. 1, which is by way of example and is merely to illustrate a typical coring assembly.

Figure 2:
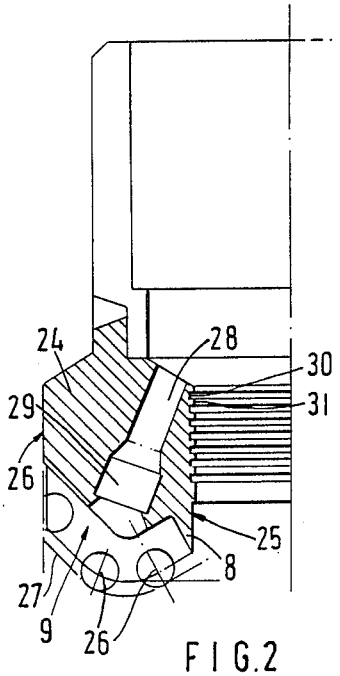
FIGS. 2 to 8 are sections though a portion of the inner gauge of a coring bit according to the invention.

FIG. 2 is a half section through one form of coring bit according to the invention. In this arrangement the inner gauge of the bit body 24 is indicated generally at 25 and the outer gauge at 26. The surface of the bit body is formed with blades 27, for example six such blades are provided, on which are mounted cutting elements 28 in the form of circular preforms having a hard cutting face of polycrystalline diamond material on a tungsten carbide backing. The precise nature of the cutting elements, and their mounting on the bit body, forms no part of the present invention and will not therefore be described in detail.

Passages 28 in the bit body lead from an enlarged aperture in the interior thereof to nozzles 29, each of which opens into the surface of the bit body in the channel 9 between two adjacent blades. For example, there may be provided six equally spaced blades and three equally spaced nozzles in alternate channels between the blades.

Each channel 9 into which a nozzle 29 opens is closed off from the central opening in the bit by a fence 8 provided by an integral extension of the bit body. The fence 8 prevents splash-back on the core of drilling fluid emerging under pressure from the associated nozzle 29.

The inner gauge 25 of the coring bit is provided with a labyrinth seal comprising a plurality of equally spaced annular channels 30 separated by lands 31.

In use of the coring bit, the lands 31 engage the surface of the core being cut and provide an hydraulic seal therewith. This may prevent any flow of drilling fluid downwardly through the central aperture in the bit, all such flow of drilling fluid taking place through the passages 28 and nozzles 29. Should there be some leakage flow past the labyrinth seal, the seal will operate, in known manner, so that the pressure drop across each land 31 is only a fraction of the total pressure drop across the bit. Consequently, since velocity of flow is dependent on the pressure drop, the velocity of flow of drilling fluid across each land will be only a fraction of the velocity which would occur if the seal were not provided. The amount of erosion of the core is dependent on the velocity of flow of the drilling fluid, rather than the volume flow, and consequently this reduction in the velocity of any drilling fluid which may leak over the surface of the core will reduce the amount of erosion caused.

Figure 3:
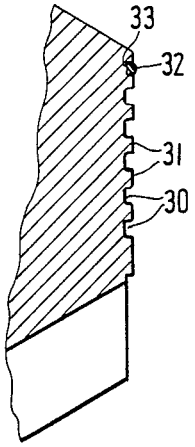

The arrangement shown in FIG. 3 provides a labyrinth seal, similar to that shown in FIG. 2, comprising equally spaced channels 30 separated by lands 31. In this arrangement, however, there is provided at the upper end of the labyrinth seal a resilient seal in the form of a rubber or synthetic rubber O-ring 32 received in an annular groove 33, which may be of dovetail section, formed in the bit body. In use, the O-ring sealingly engages the surface of the core and enhances the hydraulic seal.

Figure 4:
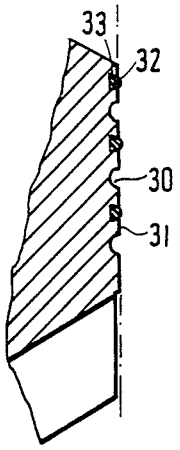

In the arrangement of FIG. 4, the lands 31 between adjacent labyrinth groove 30 are wider than in the arrangement of FIGS. 2 and 3, and a resilient O-ring seal 32, 33 is provided on each land, again to enhance the sealing effect.

Figure 5:
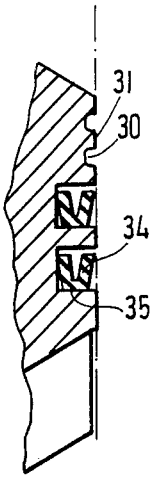

In the arrangement of FIG. 5, in addition to a short labyrinth seal 30, 31 there are provided two resilient seals comprising V-section annular elements of rubber or resilient plastics 34 housed in rectangular-section grooves 35 in the bit body. The inner limb of the V-section of the seal is urged resiliently into engagement with the surface of the core to provide an hydraulic seal therewith. Such V-section sealing elements are of a common commercially available type.

Figure 6:
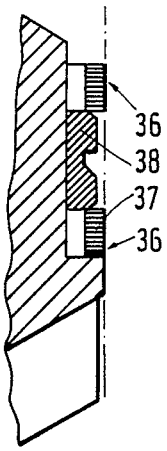

FIG. 6 shows a form of seal incorporating annular brush-like elements 36 having flexible inwardly directed bristles 37 which, in use, engage the surface of the core to form an hydraulic seal therewith. A number of annular brush seals may be provided (two being shown in FIG. 6) with annular spacers, such as 38, between them.

Figure 7:
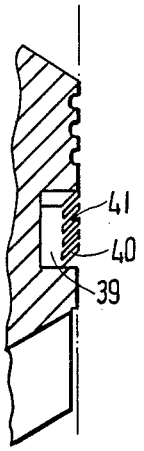
Figure 8:
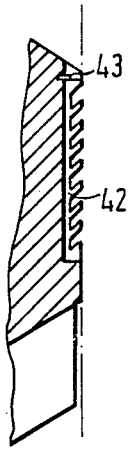

FIG. 7 shows an alternative form of annular seal. In this case the seal 39 is of the known type having a plurality of inwardly projecting annular flanges 40 separated by recesses 41, the flanges 40 being inclined upwardly away from the face of the bit. FIG. 8 shows an alternative but similar arrangement using a longer form of annular sealing member 42. The resilient sealing members 39 and 42 may be formed from rubber or other resilient material such as resilient plastics, or, for greater wear resistance, may be formed of metal, such as steel, the thinness of the flanges 40 providing the necessary resilience thereof.

Seals of the type shown in FIGS. 7 and 8 may be sprung or snapped into appropriate annular grooves in the inner periphery of the drill bit or may, as shown in FIG. 8, be retained in position by a circlip as indicated at 43.

The sealing means shown in FIGS. 2 to 8 are by way of example only and it will be appreciated that the sealing means between the inner gauge and the core might comprise virtually any conventional form of seal of a type used for providing an hydraulic seal between a circular shaft and an encircling bearing surface. Two or more different sealing means may be provided in combination to give an enhanced seal.

In the arrangements described above, the sealing means engage the surface of the core directly. However, in an alternative construction, now shown, there is provided within the core barrel a plastics liner which closely encircles the core as it is cut and in this case the sealing means engages the outer surface of the plastic liner rather than the core itself. It will be appreciated that it is necessary that the plastic liner should not rotate with the bit, and a bearing is therefore provided between the liner and the bit or core barrel.

I claim:

1. A rotary drill bit for use in coring holes in subsurface formations, comprising a bit body having a shank for connection to a core barrel, an outer peripheral gauge portion for engagement with the peripheral wall of the hole being drilled, an inner peripheral gauge portion defining at least a part of a central, generally circular aperture extending axially through the bit body, a plurality of cutting elements mounted at an end face of the bit body, at least one passage in the bit body for delivering drilling fluid to said end face of the bit body for cooling and cleaning said cutting elements, and sealing means on said inner gauge portion of the bit including an annular resilient member received in an annular groove in the inner gauge portion of the bit body, the annular resilient member being formed from resilient material and having a plurality of axially spaced annular recesses in the inwardly facing surface thereof so as to define, between the recesses, a plurality of inwardly projecting resilient annular flanges, the inner peripheries of which, in use of the bit, engages the outer peripheral surface of the core being cut by the bit in a manner to form an hydraulic seal and prevent or restrict flow of drilling fluid in an axial direction between the inner gauge portion and the core.

2. A rotary drill bit according to claim 1, wherein said central aperture extending axially through the bit body includes an inner part of larger cross section than the part defined by the inner gauge portion, and wherein at least one passage for delivering drilling fluid to the end face of the bit body extends through the bit body from said larger cross section part of the aperture to the end face of the bit.

3. A rotary drill bit according to claim 1, wherein said inwardly projecting annular flanges are inclined away from the end face of the bit body.

4. A rotary drill bit for use in coring holes in subsurface formations, comprising a bit body having a shank for connection to a core barrel, an outer peripheral gauge portion for engagement with the peripheral wall of the hole being drilled, an inner peripheral gauge portion defining at least a part of a central, generally circular aperture extending axially through the bit body, a plurality of cutting elements mounted at an end face of the bit body, at least one passage in the bit body for delivering drilling fluid to said end face of the bit body for cooling and cleaning said cutting elements, and sealing means on said inner gauge portion of the bit including a labyrinth seal comprising a number of axially spaced peripheral annular grooves, separated by peripheral lands, in the surface of the inner gauge portion, which lands, in use, engage the outer surface of the core being cut by the bit in a manner to form an hydraulic seal and prevent or restrict flow of drilling fluid in an axial direction between the inner gauge portion and the core.

5. A rotary drill bit according to claim 4, wherein said central aperture extending axially through the bit body includes an inner part of larger cross section than the part defined by the inner gauge portion, and wherein at least one passage for delivering drilling fluid to said end face of the bit body extends through the bit body from said larger cross section part of the aperture to said end face of the bit.

* * * * *